United States Patent [19]

Croucher et al.

[11] Patent Number: 4,797,342

[45] Date of Patent: Jan. 10, 1989

[54] PROCESSES FOR THE PREPARATION OF LIQUID DEVELOPERS WITH LOW VAPOR PRESSURE COMPONENTS

[75] Inventors: Melvin D. Croucher, Oakville; Raymond W. Wong, Mississauga; Stephan Drappel, Toronto, all of Canada

[73] Assignee: Xerox Corporation, Stamford, Conn.

[21] Appl. No.: 124,230

[22] Filed: Nov. 23, 1987

[51] Int. Cl.[4] ..... G03G 9/12

[52] U.S. Cl. ..... 430/137; 430/115

[58] Field of Search ..... 430/115, 137

[56] References Cited

U.S. PATENT DOCUMENTS

| | | | |
|---|---|---|---|
| 3,954,640 | 5/1976 | Lu et al. . | |
| 4,024,292 | 5/1977 | Lu et al. . | |
| 4,268,597 | 5/1981 | Klavan et al. | 430/102 |
| 4,454,215 | 6/1984 | Landa | 430/115 |

FOREIGN PATENT DOCUMENTS

| | | | |
|---|---|---|---|
| 57-201243 | 12/1982 | Japan | 430/137 |

*Primary Examiner*—Roland E. Martin

*Attorney, Agent, or Firm*—E. O. Palazzo

[57] ABSTRACT

A process for the preparation of liquid developer compositions which comprises mixing a resin with a low vapor pressure oil at elevated temperatures permitting the resin to melt and enabling the formation of a resin oil mixture; thereafter adding to the oil resin mixture at elevated temperature pigment particles, and stirring until the pigment has become dispersed in the resin; followed by attriting the mixture while cooling, for example, to ambient temperatures; thereafter filtering the aforementioned mixture, and dispersing the product in a low viscosity oil; and subsequently adding to the formed mixture a change control additive.

19 Claims, No Drawings

PROCESSES FOR THE PREPARATION OF LIQUID DEVELOPERS WITH LOW VAPOR PRESSURE COMPONENTS

BACKGROUND OF THE INVENTION

This invention is generally directed to processes for the preparation of liquid developer compositions, especially liquid developers wherein there is selected a low vapor pressure component that is entrapped in the developer. More specifically, the present invention is directed to a process for the preparation of liquid developer compositions which comprises entrapping a low vapor pressure component, for example about 0.01 millimeter of mercury, in a resin material. Thus, in one embodiment of the present invention the process involved comprises the preparation of resin particles containing a pigment in the low vapor pressure component, and thereafter adding thereto pigment particles and charge directing additives enabling liquid developers wherein the low vapor pressure component is entrapped within the resin preventing its undesirable evaporation, or release into the environment after fusing of a developed electrostatic image. In a further embodiment of the present invention, there is provided a process for the preparation of liquid ink compositions which comprises heating a resin component to above its melting point in a low vapor pressure oil, which heating is usually accomplished at a temperature of from about 80° to about 130° C.; thereafter dispersing the pigments such as carbon black in the resulting heterogeneous oil/resin mixture; and cooling the dispersion to room temperature, which is usually accomplished over a period of from about 4 to about 6 hours while simultaneously attriting this mixture resulting in particles of a suitable average diameter, usually from about 2 to about 3 microns in a preferred embodiment of the present invention. The aforementioned process enables both the pigment and the oil to be entrapped within the resin particles. Also, the dispersion formed is added to a low viscosity oil, such as Isopar, together with the charge director to enable the formation of an electrophoretic liquid developer composition. Accordingly, upon fusing the formed liquid developer composition in an imaging or printing apparatus the low vapor pressure oil present is permanently trapped within the resin thereby eliminating any odor which might emanate from the imaging or printing apparatus as is the situation, for example, when a high vapor pressure or volatile oil is selected for the formation of the developer compositions. With further respect to the formed liquid developers, they are referred to as electrophoretic developers; according, it is necessary to disperse them in a low viscosity oil to enable them to migrate to the latent electrostatic image within short time periods, that is within milliseconds. Therefore, as the mobility of the ink is believed to be directly related to the viscosity of the dispersion medium, a low viscosity oil, for example from 1 to about 3 centipoises, is selected as the dispersion medium for the developer particles. The liquid inks of the present invention can be selected for the development of images in various processes, inclusive of xerographic processes, electrostatic printing, and facsimile systems; color proofing processes; and the process as illustrated in Savin British Patent Publication No. 2,169,416, published July 9, 1986, the disclosure of which is totally incorporated herein by reference.

Development of electrostatic latent images with liquid developer compositions commprised of, for example, a dispersion of pigments in a liquid hydrocarbon are known. In these methods, the electostatic latent image, which is usually formulated on a photoconductive member, is transported through a bath of the aforementioned liquid developer. Contact with the liquid developer causes the charged pigment particles present therein to migrate through the liquid to the photoreceptor surface in the configuration of a charged image. Thereafter, the toner electrostatic image is then electrostatically transferred from the photoconductor surface to plain paper. The image transfer efficiency from the photoreceptor to the paper is typically about 50 to 60 percent since the phenomenon of ink splitting between the photoreceptor and the paper usually occurs. In this process, the excess liquid toner remaining on the photoreceptor has to be cleaned therefrom prior to the next image cycle, and the excess toner discarded. Also, as only about 50 to 60 percent of the liquid toner is transferred to paper, the optical density of the image is often unacceptably low. For example, with the compositions and processes illustrated in U.S. Pat. No. 4,476,210 the reflection optical density of black liquid toner images is typically of from 1.0 to 1.1 while dry developers typically exhibit values of 1.2 to 1.4. Further, liquid toners exhibiting transfer efficiencies greater than about 80 percent also provide dense black images of optical density greater than 1.2, thus minimizing the amount of toner that has to be discarded and rendering an effective cleaning of the photoreceptor surface. The thin film of residual developer remaining on the surface of the sheet is then evaporated within a relatively short time period, usually less than 5 seconds. Also, the making pigment particles may be fixed to the sheet by heat, for example, in image configuration.

There are disclosed in U.S. Pat. No. 3,554,946 liquid developers for electrophotography comprised of a carrier liquid consisting of a hydrocarbon, negatively electrostatically charged toner particles dispersed in the carrier liquid, and a pigment therein such as carbon black, aniline black, prussion blue, phthalocyanine red, and cadmium yellow. In accordance with the teachings of this patent, a copolymer is coated on the surface of the pigment particles for the primary purpose of imparting a negative electrostatic charge to these particles. Other patents disclosing similar liquid developer compositions include U.S. Pat. Nos. 3,623,986; 3,625,897; 3,900,412; 3,976,583; 4,081,391 and 3,900,412. In U.S. Pat. No. 3,900,412, there is specifically disclosed a stable developer comprised of a polymer core with a steric barrier attached to the surface of the polymer selected. In column 15 of this patent, there are disclosed colored liquid developers by selecting pigments or dyes, and physically dispersing them by ball milling or high shear mixing. Attempts to obtain color liquid developer compositions by the ball milling process described have been unsuccessful, particularly with respect to obtaining developed images of acceptable optical density in that, for example, the desired size for the latex particles is from 0.2 to 0.3 micron in diameter; and with ball milling techniques it is very difficult to provide a dispersion of carbon black or other pigment particles much smaller in size than about 0.7 to 0.8 micron. Consequently, the addition of carbon black pigment particles, for example to latex particles with a diameter of 0.2 to 0.3 micron, result after ball milling in relatively small latex particles residing on the surface of the pigment particles.

Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in U.S. Pat. No. 4,476,210, reference columns 1 and 2 thereof.

Furthermore, there is illustrated in British Patent Publication No. 2,169,416, the disclosure of which is totally incorporated herein by reference, liquid developer compositions comprising toner particles associated with a pigment dispersed in a nonpolar liquid, and wherein the toner particles are formulated with a plurality of fibers or tendrils from a thermoplastic polymer, and possess a charge opposite to the polarity of the latent image. These toners apparently permit in some instances excellent transfer efficiencies, however, they have been found to be difficult to prepare, for example, it has been found difficult to obtain the same result from batch-to-batch with this mechanical process. Also, the time needed to prepare such particles of the order of up to 30 hours, which is uneconomical. Furthermore, since the preferred resin, for example Elvax II 5720, is Isopar insoluble, it entraps Isopar during the mechanical grinding process. Consequently, during the fusing step energy has to be expended in driving Isopar out of the resin as well as fixing it to the paper surface, which enables as an energy inefficient liquid toner.

Other prior art of interest include U.S. Pats. Nos. 4,454,215 and 4,058,774 directed to liquid developers, and more specifically suitable toner particles present in a specific liquid carrier while considering the composition of the toner particles so as to form readily disassociated flocs. reference column 4, lines 63 to 68, and continuing on to column 5, lines 1 to 14; U.S. Pat. Nos. 3,954,640; 4,024,292; and 4,268,597, which disclose liquid developers with vehicles of Magie Oil 520 or 620. Patents primarily of background interest are U.S. Pat. Nos. 4,306,009; 4,363,863; 4,374,918 and 4,521,505. The main disadvantage associated with the aforementioned prior art inks resides in the small particle size.

Although the above described liquid inks, and processes for the preparation thereof are suitable for their intended purposes, there remains a need for new processes. More specifically, there is a need for processes for the preparation of liquid developers wherein the vehicle component is entrapped, and thus cannot be released as is the situation with some prior art inks. There also is a need for the preparation of colored liquid developers which possess the aforementioned characteristics. Additionally, there is a need for the preparation of liquid developer compositions that permit images of excellent resolution in a number of known imaging processes. Moreover, there is a need for liquid developer processes wherein the colorants selected are suitably dispersed in a resin such that the primary particles are preferably of an average diameter of from about 2 to about 3 microns, thus enabling black or colored images of excellent resolution. Further, there remains a need for liquid developer processes wherein there are included in the final compositions other additives, inclusive of charge directors. There is also a need for processes for the preparation of liquid developers with entrapped vehicles thereby permitting a reduction in the amount of energy needed, about 25 percent for example, for fusing; and where long term copy odor problems are avoided. Additionally there is a need for processes for liquid developers with low vapor pressure entrapped components, such as Magiesols, enabling a reduction in the amount of this component that is released to the environment.

SUMMARY OF THE INVENTION

It is an object of the present invention to provide processes for liquid developer compositions.

In another object of the present invention there are provided processes for black and colored liquid developer compositions with entrapped low vapor pressure vehicles, which compositions can be selected for use in several different imagning systems.

In yet another object of the present invention there are provided processes for liquid developer compositions with superior transfer efficiencies, that is for example greater than 80 percent, and in some embodiments 99.5 percent.

It is an additional object of the present invention to provide processes for liquid developer compositions with transfer efficiencies of 80 percent or greater.

Furthermore, in another object of the present invention there are provided processes for liquid developer compositions with black, cyan, magenta or yellow colors, and mixtures thereof.

Moreover, there is a need for processes for ink compositions that are useful in various development systems, inclusive of electrostatic, printing, color proofing methods, and the like.

Additionally, in another object of the present invention there are provided processes for black and colored liquid developer compositions with entrapped vehicles that possess a vapor pressure of 0.01 millimeter of mercury thereby avoiding the release of these vehicles to the environment, and permitting a reduction in the fusing energy.

Moreover, there is a need for processes for ink compositions that are useful in various development systems, inclusive of electrostatic, printing, color proofing methods, and the like, wherein the entrapped vehicle is of a low vapor pressure and does not escape from the resin over a period of time, thus preventing the detection of any offensive odors.

In addition, there is a need for ink compositions possessing a primary particle size average diameter of from about 2 microns to about 3 microns.

These and other objects of the present invention are accomplished by providing processes for liquid toner compositions. More specifically, in one embodiment the present invention is directed to a process for the preparation of liquid developer compositions with transfer efficiencies of 80 percent or greater, wherein the vehicle component is entrapped in the liquid developer. In one specific embodiment of the present invention, there are provided processes for liquid developer compositions, which comprises mixing resin particles with a low vapor pressure vehicle, and subsequently adding thereto pigment particles and charge directors enabling developers with entrapped vehicles. More specifically, in one particular embodiment of the present invention the liquid developer compositions are prepared by mixing a resin component such as Elvax II 5720 available from E. I. DuPont Company, and a low vapor pressure oil at, for example, a temperature of 110° C. causing the resin to melt thereby enabling the formation of a resin-/oil mixture wherein the oil functions as a diluent for the resin and lowers its viscosity. Generally, the oil is present in the mixture in an amount of from about 80 percent by weight to about 90 percent by weight, and preferably in an amount of from about 82 to about 94 percent by weight, while the vapor pressure of this oil should preferably be from about 0.01 to about 0.1 millimeter of mercury. Preferred oils selected include Isopar V available from Exxon, and Magiesol 60, available from Magie Brothers, which oils are water white and odorless thus avoiding environmental hazards present with some of the prior art liquid developers.

Subsequently, to the above-prepared oil resin mixture at about 110° C. there is added the pigment such as carbon black, cyan, magenta or yellow, and the like, which pigment is present in an amount of from about 1 to about 25 percent by weight of the resin, and preferably is present in an amount of from about 12 percent by weight to about 22 percent by weight. Examples of pigments that can be selected include Mogul L, available from Cabot Corporation, Raven 575 available from Columbian Chemical, Raven 350 available from Columbian Chemical, Regal$^R$ 330 carbon black available from Cabot Corporation, Vulcan XC-72R available from Cabot Corporation, Sudan Blue OS available from Ciba-Geigy, Hostaperm Pink E available from American Hoechst, Novaperm 3010 available from American Hoechst, mixtures thereof; and the like.

After dispersion of the pigment in the molten resin, the mixture obtained is cooled to room temperature over a period, for example, of from about 4 to about 6 hours enabling particles with an average diameter of from about 2 to about 3 microns. These particles can then be filtered, for example, through a 1 micron mesh filter for the purpose of removing any excess oil and any submicron size particles; followed by dispersing the resulting particles in a low viscosity oil such as known petroleums for liquid developers including Isopar G or Isopar L, Elvax, and the like. Generally, the concentration of the pigment particles in the low viscosity oil is from about 0.5 percent by weight to about 10 percent by weight, and preferably from about 0.8 percent by weight to about 4 percent by weight. Thereafter, a charge control agent is added to the dispersion formed to enable an electrophoretic liquid developer composition.

Examples of charge control agents that may be selected for the liquid developer compositions of the present invention, and that are present in an amount of from about 0.01 percent by weight to about 2.0 percent by weight, and preferably in an amount of from about 0.02 percent by weight to about 0.05 percent by weight, include the cadmium, calcium, manganese, magnesium and zinc salts of heptanoic acid; the barium, aluminum, cobalt, manganese, zinc, cerium and zirconium salts of 2-ethyl hexanoic acid (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum dresinate, and the aluminum salt of 3,5 di-t-butyl gamma resorcylic acid. Mixtures of these materials may also be used. Preferred charge control additives are polyisobutylene succinimide, commercially available as OLOA 1200 from Chevron Chemical Company, and lecithin, commercially available from Fisher Scientific Company. The aforementioned preferred charge control additives can impart a negative charge to toner composition, which charge is dependent primarily on the interaction of the molecularly dissolved charge additive, and the pigment particles on the surface of the composite resin/pigment particle.

The ink compositions formulated in accordance with the process of the present invention are particularly useful in liquid development systems, such as those illustrated in the aforementioned British Patent Publication, and color proofing processes. More specifically, these processes involve depositing an electrostatic charge pattern on a photoreceptor or a dielectric surface, and then toning the electrostatic image with the liquid developers formulated in accordance with the processes of the present invention, followed by electrostatically transferring to plain paper. In addition, the liquid developer compositions formulated in accordance with the processes of the present invention are also useful for enabling the development of colored electrostatic latent images, particularly those contained on an imaging member charged positively. For a positively charged electrostatic image, a negatively charge liquid developer must be used. Examples of imaging members that may be selected include selenium and selenium alloys, zinc oxide, cadmium sulfide, hydrogenated amorphous silicon, as well as ionographic surfaces of various dielectric materials such as polycarbonate polysulfone fluoropolymers, anodized aluminum alone or filled with wax expanded fluoropolymers.

With further respect to the present invention, there is provided a process for the preparation of liquid developer compositions, which comprises admixing molten resin components in a vehicle component possessing a vapor pressure of from about 0.01 to about 0.1 millimeter of mercury; thereafter adding thereto pigment particles, subsequently cooling the aforementioned mixture thereby enabling entrapment of the vehicle in the developer composition; and thereafter adding to the formed composition a charge control direction component. Additionally, another embodiment of the present invention comprises a process for the preparation of liquid developer compositions, which comprises mixing a resin with a low vapor pressure oil at elevated temperatures permitting the resin to melt and enabling the formation of a resin oil mixture; thereafter adding to the oil resin mixture at elevated temperatures pigment particles, and stirring until the pigment has become dispersed in the resin; thereafter filtering the aforementioned mixture and dispersing the product in a low viscosity oil; and subsequently adding to the formed mixture a charge control additive.

The following examples are being supplied to further define specific embodiments of the present invention, it being noted that these examples are intended to illustrate and not limit the scope of the present invention. Parts and percentages are by weight unless otherwise indicated.

EXAMPLE I

To 1,750 grams (g) of ¼ inch stainless steel balls present in a Union Process 01 attritor there was added 170 grams of Isopar V (Exxon) and 12 grams of Elvax II 5720 (Dupont).

The attritor was heated to 110° C. under constant stirring after which 3 grams of Mogul L (Cabot Corporation) was added to the mixture and dispersion continued for a further hour. The attritor was then cooled to 30° C. over a period of two hours. Attrition was continued for a further two hours at 30° C. Thereafter, the attritor was then discharged and the concentrate filtered to remove excess Isopar V, and the particles dispersed in Isopar G to a 2 percet solids concentration. To 100 milliliters (mls) of the aforementioned dispersion was added, 1 ml of a 12 weight percent mixture of OLOA 1200 (Chevron) (which is a polyisobutene succinimide which functions as a charge control agent) in Isopar G yielding a negatively charged transfer liquid ink composition. After allowing the particles to reach an equilibrium charge by resting for 24 hours, the ink was imaged in a Savin 780 liquid copier fitted with an amorphous selenium photoreceptor, which exhibits a contrast potential of 800 volts. After imaging and radiant fusing, the copies resulting, which exhibited a black solid area density of 1.2, were placed in a closed container and tested for oil retention with gas-liquid chromatography. It was found that about 3 milligrams of Isopar V could be detected at 30° C. over a period of 96 hours. Also, there resulted developed copies which were odorless to an observer within 15 minutes after exiting from the copier.

EXAMPLE II

A liquid developer composition was prepared by repeating the procedure of Example I with the exception that there was selected Sudan Blue OS in place of Mogul L as the pigment. Substantially identical results regarding long term solvent carryout were observed by gas liquid chromatography over a period of 96 hours.

EXAMPLE III

A liquid developer composition was prepared by repeating the procedure of Example I with the exception that Magiesol 60 was selected in place of Isopar V. The gas liquid chromatography results after imaging indicate that zero solvent was emitted by the developed copies within 15 minutes of exiting from the fuser of the Savin copier.

EXAMPLE IV

A liquid developer composition was prepared by repeating the procedure of Example III with the exception that Lecithin was used as the charge control agent in place of OLOA 1200. Excellent results were obtained and no oil was detected as emanating from the copies after being open to the environment for more than 15 minutes.

Other modifications of the present invention will occur to those skilled in the art subsequent to a review of the present application. These modifications, and equivalents thereof are intended to be included within the scope of this invention.

What is claimed is:

1. A process for the preparation of liquid developer compositions which comprises admixing molten resin components in a vehicle component possessing a vapor pressure of from about 0.01 to about 0.1 millimeter of mercury; thereafter adding thereto pigment particles; subsequently cooling and attriting the aforementioned resulting mixture thereby enabling entrapment of the vehicle in the developer composition; thereafter filtering and dispersing the resulting particles in a low viscosity oil; and adding to the formed composition a charge control director component.

2. A process for the preparation of liquid developer compositions which comprises mixing a resin with a low vapor pressure oil at elevated temperatures permitting the resin to melt and enabling the formation of a resin oil mixture; thereafter adding to the oil resin mixture at elevated temperatures pigment particles, and stirring until the pigment has become dispersed in the resin; cooling the mixture with attrition, thereby enabling entrapment of said oil in the developer composition; thereafter filtering the aforementioned mixture, and dispersing the product in a low viscosity oil; and subsequently adding to the formed mixture a charge control additive.

3. A process in accordance with claim 2 wherein the mixing is accomplished at a temperature of from about 90° to about 110° C.

4. A process in accordance with claim 2 wherein the low vapor pressure oil is present in the mixture in an amount of from about 80 percent by weight to about 90 percent by weight.

5. A process in accordance with claim 2 wherein the vapor pressure of the oil selected is from about 0.01 to about 0.1 millimeter of mercury.

6. A process in accordace with claim 2 wherein the low vapor pressure oil is selected from the group consisting of Isopar V and Magiesol 60.

7. A process in accordance with claim 2 wherein the pigment particles are selected from the group consisting of carbon black, cyan, magenta, yellow, or mixtures thereof.

8. A process in accordance with claim 7 wherein the pigment is present in an amount of from about 3 percent by weight to about 25 percent by weight.

9. A process in accordance with claim 2 wherein subsequent to dispersion of the pigment in the resin particles the mixture is allowed to cool to room temperature over a period of from about 3 to about 5 hours enabling particles with an average diameter of from about 2 to about 3 microns.

10. A process in accordance with claim 2 wherein the charge director is present in an amount of from about 0.01 to about 2 percent by weight.

11. A process in accordance with claim 2 wherein the charge director is selected from the group consisting of polyisobutylene succinimide and lecithin.

12. A process in accordance with claim 2 wherein the developers possess an image transfer efficiency of from about 80 percent to about 99.8 percent.

13. A process in accordance with claim 2 wherein the charge control additive is present in an amount of from about 0.02 percent by weight to about 0.05 percent by weight.

14. A process in accordance with claim 2 wherein the charge director is selected from a group consisting of salts of cadmium, calcium, manganese, magnesium, and zinc salts of heptanoic acid.

15. A process in accordance with claim 2 wherein the charge director is selected from barium, aluminum, cobalt, manganese, zinc, cerium and zirconium salts of 2-ethyl hexanoic acid.

16. A process in accordance with claim 1 wherein the charge director is selected from the group consisting of the barium, aluminum, zinc, copper, lead and iron salts of stearic acid.

17. A process in accordance with claim 1 wherein the charge director is selected from the group consisting of polyisobutylene succinimide and lecithin.

18. A process in accordace with claim 1 wherein the low viscosity oil is Isopar G or Isopar L.

19. A process in accordance with claim 2 wherein the low viscosity oil is Isopar G or Isopar L.

* * * * *